US009624053B2

(12) United States Patent
Otsuka

(10) Patent No.: US 9,624,053 B2
(45) Date of Patent: Apr. 18, 2017

(54) RECORDING APPARATUS WITH A MEDIUM RESTRICTING PORTION

(71) Applicant: SEIKO EPSON CORPORATION, Tokyo (JP)

(72) Inventor: Kazuo Otsuka, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/991,763

(22) Filed: Jan. 8, 2016

(65) Prior Publication Data

US 2016/0221368 A1 Aug. 4, 2016

(30) Foreign Application Priority Data

Feb. 2, 2015 (JP) ..... 2015-018140

(51) Int. Cl.

*B65H 3/06* (2006.01)
*B41J 13/10* (2006.01)
*B65H 3/56* (2006.01)

(52) U.S. Cl.

CPC ..... *B65H 3/0661* (2013.01); *B41J 13/103* (2013.01); *B65H 3/0623* (2013.01); *B65H 3/0653* (2013.01); *B65H 3/56* (2013.01); *B65H 2404/72* (2013.01)

(58) Field of Classification Search

CPC ..... B65H 3/0661; B65H 3/0653; B65H 3/56; B65H 3/0623; B65H 2404/72; B41J 13/103

See application file for complete search history.

(56) References Cited

U.S. PATENT DOCUMENTS

| | | | |
|---|---|---|---|
| 2001/0019349 A1 | 9/2001 | Kawakami | |
| 2009/0245907 A1 | 10/2009 | Takata et al. | |
| 2010/0329763 A1 | 12/2010 | Hattori | |

FOREIGN PATENT DOCUMENTS

| | | | |
|---|---|---|---|
| JP | 2001-315409 | 11/2001 | |
| JP | 2009-242031 | 10/2009 | |
| JP | 2010-023949 | * 2/2010 | ..... B65H 1/04 |
| JP | 2010-168221 | 8/2010 | |
| JP | 2011-007910 | 1/2011 | |
| JP | 2013-107244 | 6/2013 | |

* cited by examiner

*Primary Examiner* — Henok Legesse
(74) *Attorney, Agent, or Firm* — Workman Nydegger

(57) ABSTRACT

A recording apparatus comprises: a medium tray on which a medium is set vertically, or with a tilt; a feed roller that feeds the medium set on the medium tray by rotating while being in contact with the medium; a recording unit that performs recording on the medium; an urging mechanism for urging the medium and/or the feed roller in a direction of coming closer; and a restricting portion that faces a recording surface at a lower edge portion of the medium set on the medium tray and restricts movement of the lower edge of the medium, wherein the feed roller feeds the medium so that the lower edge of the medium can get over an upper end of the restricting portion.

8 Claims, 10 Drawing Sheets

RECORDING APPARATUS WITH A MEDIUM RESTRICTING PORTION

BACKGROUND

1. Technical Field

The present invention relates to a recording apparatus.

2. Related Art

In a recording apparatus such as an ink-jet printer that performs recording on a medium at its recording unit, plural sheets of paper, as the medium, are set on a paper-stacking surface of a hopper that can be moved pivotally in relation to a feeding means such as a paper feed roller. The hopper moves pivotally to position the top sheet of paper to be into contact with the feeder roller, and the feeder roller rotates. By this means, sheets are fed downstream in the medium transportation direction sequentially, one sheet at a time, beginning with the top sheet.

Examples of such a recording apparatus are disclosed in JP-A-2010-168221 and JP-A-2010-023949.

If the surface on which sheets are stacked is in vertical orientation or steep-slope orientation, there is a risk of an avalanche phenomenon, which is the downward surge of the leading edge of the sheets stacked on the surface.

SUMMARY

An advantage of some aspects of the invention is to provide a recording apparatus that can prevent the downward surge of the leading edge of sheets set on a paper-stacking surface in a case where the surface is in vertical orientation or steep-slope orientation.

A recording apparatus according to a first mode of the invention comprises: a medium tray on which a medium is set vertically, or with a tilt; a feed roller that feeds the medium set on the medium tray by rotating while being in contact with the medium; a recording unit that performs recording on the medium; an urging mechanism for urging the medium and/or the feed roller in a direction of coming closer; and a restricting portion that faces a recording surface at a lower edge portion of the medium set on the medium tray and restricts movement of the lower edge of the medium, wherein the feed roller feeds the medium so that the lower edge of the medium can get over an upper end of the restricting portion.

In this mode, the distance of feeding by the paper feed roller is a distance by which the leading edge of the medium restricted by the restricting portion can get over the restricting portion. Since the restricting portion restricts the movement of the leading edge of the medium set on the medium tray, even in a case where the medium tray is in vertical orientation or steep-slope orientation, it is possible to prevent, or reduce a risk of, the downward surge of the leading edge of the set medium.

In a recording apparatus according to a second mode, in the first mode, the feed roller may rotate by receiving a driving force from a driving source; and the driving source may perform driving until the medium gets over the restricting portion, and the driving of the driving source may be stopped after the medium has gotten over the upper end of the restricting portion.

This mode realizes a simple structure for the operation of feeding the medium from the medium tray by the feed roller and the releasing of the feed operation.

In a recording apparatus according to a third mode, in the first mode, the feed roller may have an arc portion that can be brought into contact with the medium to feed the medium, and a flat portion that is never in contact with the medium, and the contact with the medium having gotten over the upper end of the restricting portion may be released when the flat portion is positioned to face the medium.

This mode realizes a simple structure for the operation of feeding the medium from the medium tray by the feed roller and the releasing of the feed operation.

In a recording apparatus according to a fourth mode, in the second mode, the feed roller may be provided on a pivotable arm that pivots on a pivot shaft; and the pivot shaft may be provided at a downstream side with respect to the feed roller.

With this mode, when the feed roller feeds the medium toward the upstream side, a contact angle (wedge angle) formed by the pivotable arm and the medium makes it possible to obtain the pressing force of the feed roller against the medium by wedge effects.

In a recording apparatus according to a fifth mode, in the second mode, the feed roller may be provided on a pivotable arm that pivots on a pivot shaft; and the pivotable arm may include, as the urging mechanism, an urging member that urges the feed roller in a direction in which the feed roller comes closer to the medium.

With this mode, it is possible to supplement the pressing force of the feed roller against the medium by the urging member.

In a recording apparatus according to a sixth mode, in the first mode, the feed roller may have a sloped surface functioning as a guide that helps the lower edge of the medium picked up from the medium tray to get over the restricting portion.

With this mode, it is possible to reduce a risk that the leading edge of the top sheet of the medium will get caught on the restricting portion. By this means, the medium can get over the restricting portion smoothly.

In a seventh mode, a recording apparatus according to the first mode may further comprise: a pair of transportation rollers that is provided between the restricting portion and the recording unit and transports the medium toward the recording unit while nipping the medium; wherein feeding of the medium by the feed roller may be released after the medium has gotten over the upper end of the restricting portion, and the medium moves due to its own weight to a nip position of the pair of transportation rollers.

The leading edge of the medium moves to arrive at the nip position of the pair of transportation rollers due to sheet's own weight without being fed by the feed roller. Therefore, with this mode, it is possible to shorten the feed distance of the feed roller. That is, the contact of the feed roller and the paper before the arrival of the paper at the nip position of the pair of transportation rollers is reduced. This makes it possible to prevent, or reduce a risk of, the occurrence of the skew of the medium arising from feeding by the feed roller.

In a recording apparatus according to an eighth mode, in the first mode, the lower edge of the medium may move to the nip position of the pair of transportation rollers in a state in which the driving of the pair of transportation rollers is stopped.

With this mode, since the leading edge of the medium comes into alignment with the nip portion of the pair of transportation rollers that is in a stopped state, it is possible to correct the skew of the medium more reliably. This realizes medium transportation with increased stability in its attitude.

BRIEF DESCRIPTION OF THE DRAWINGS

The invention will be described with reference to the accompanying drawings, wherein like numbers reference like elements.

FIG. 4A shows a state before separation, and FIG. 4B shows a state in which the top sheet of paper has been fed to a position upstream of a restricting portion.

FIG. 5A shows a state in which the leading edge of the separated sheet has gotten over the upper end of the restricting portion, and FIG. 5B shows a state in which the leading edge of the separated sheet has arrived at the nip portion of a pair of transportation rollers.

FIG. 7A shows a state before separation, and FIG. 7B shows a state in which the top sheet of paper has been fed to a position upstream of a restricting portion.

FIG. 8A shows a state in which the leading edge of the separated sheet has gotten over the upper end of the restricting portion, and FIG. 8B shows a state in which the leading edge of the separated sheet has arrived at the nip portion of a pair of transportation rollers.

FIG. 9A shows a state before separation, and FIG. 9B shows a state in which the top sheet of paper is separated.

DESCRIPTION OF EXEMPLARY EMBODIMENTS

With reference to the accompanying drawings, a recording apparatus according to an exemplary embodiment of the invention will now be explained. The scope of the invention is not limited to the examples described below.

First Embodiment

Figure 1:
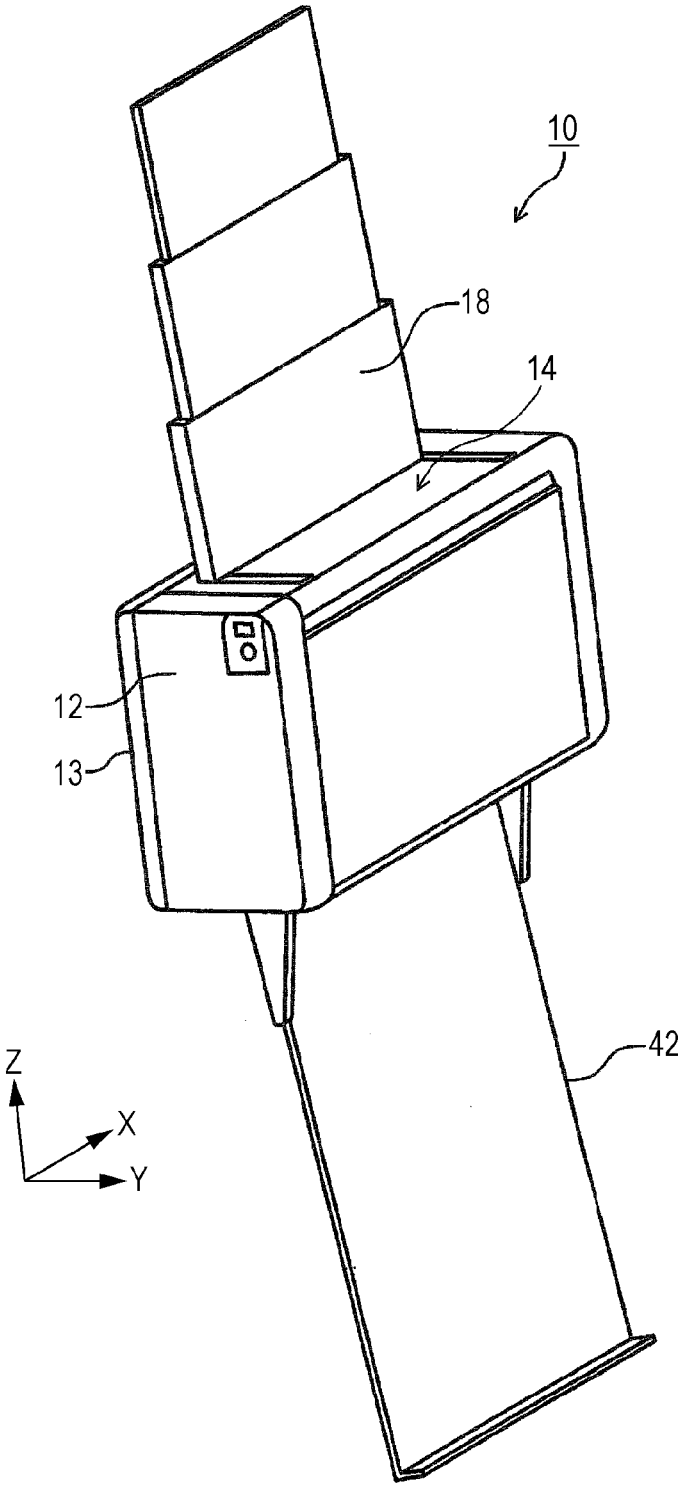
FIG. 1 is a perspective view of the body of a printer according to an embodiment of the invention.
Figure 2:
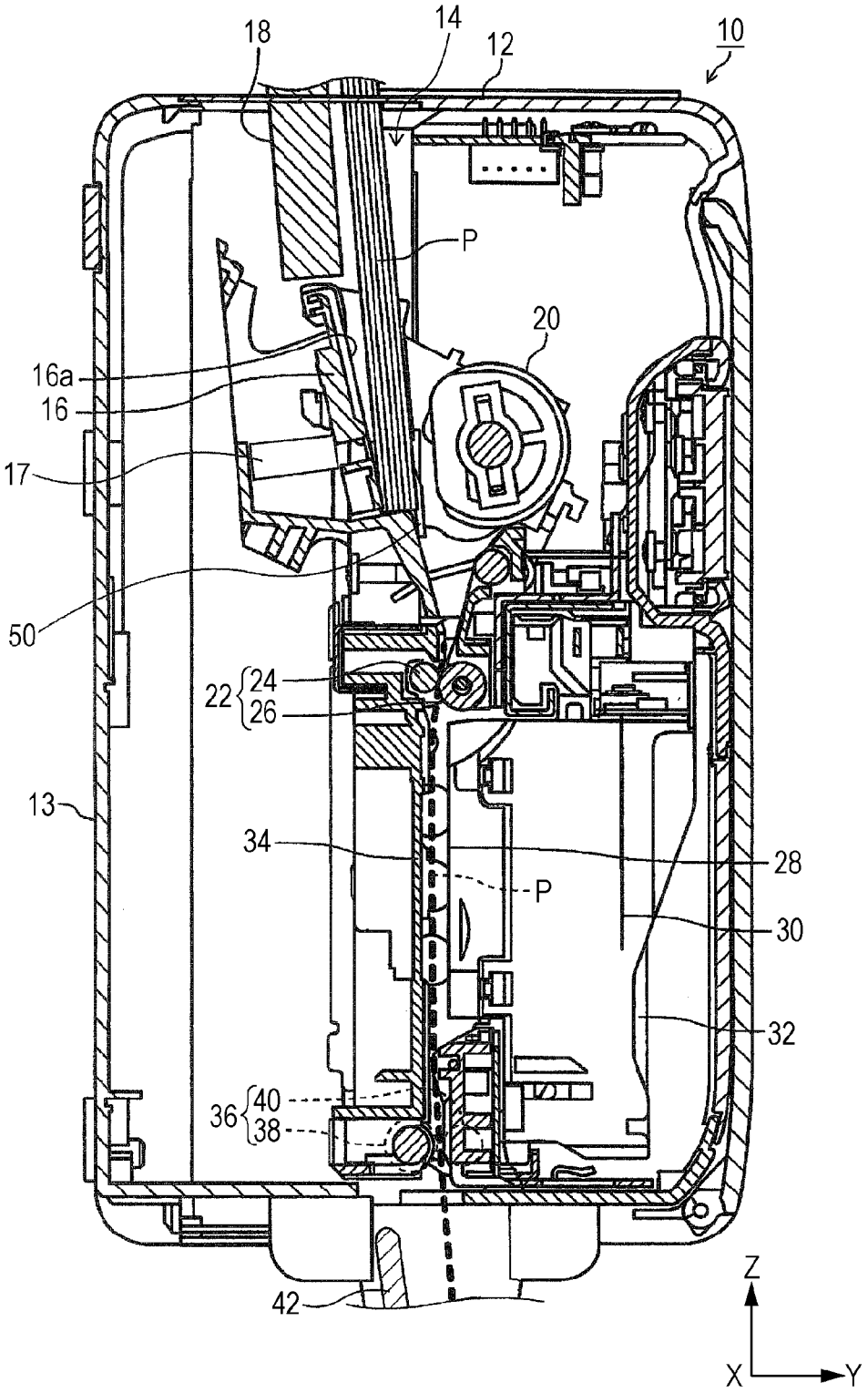
FIG. 2 is a side sectional view of the medium transportation path of a printer according to an embodiment of the invention.
Figure 3:
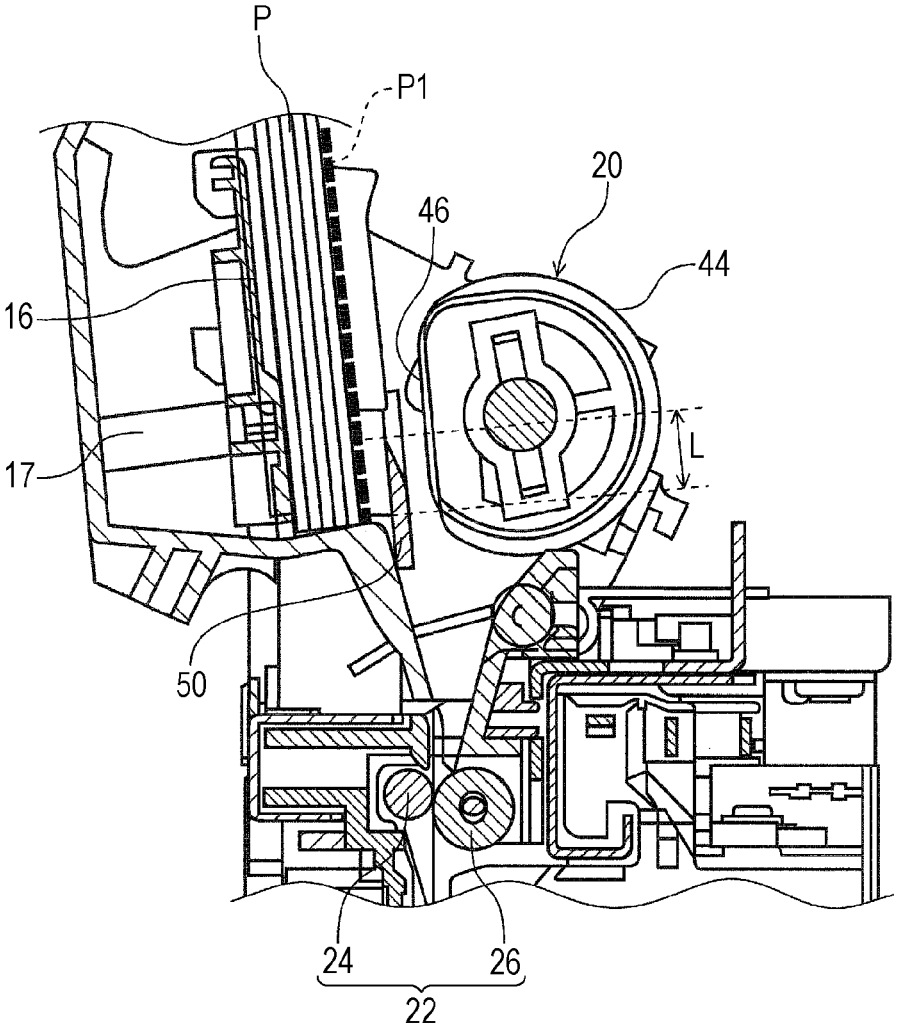
FIG. 3 is an enlarged view of an essential part of a printer according to an embodiment of the invention.
Figure 4A:
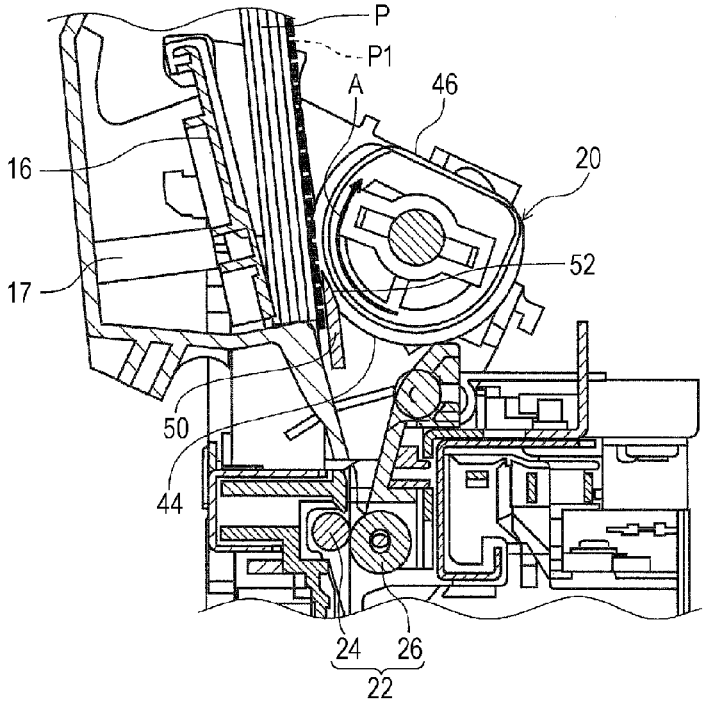
FIGS. 4A and 4B are diagrams for explaining a separation mechanism according to an embodiment of the invention; specifically.
Figure 4B:
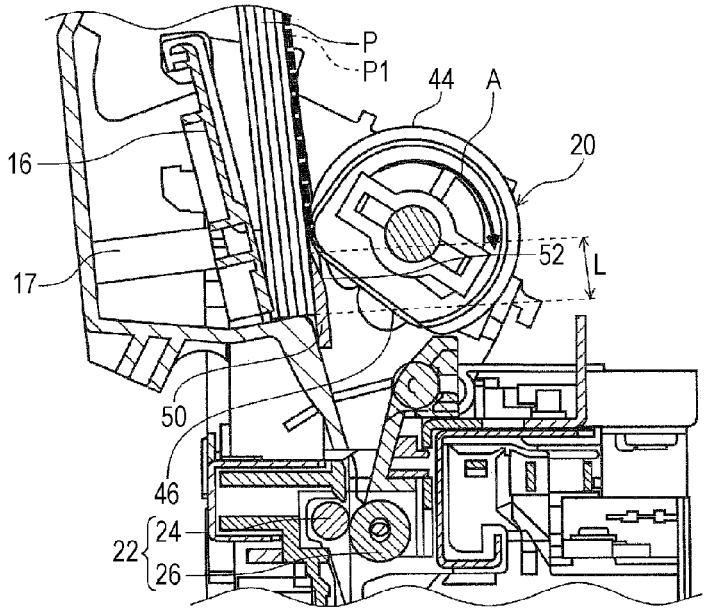
Figure 5A:
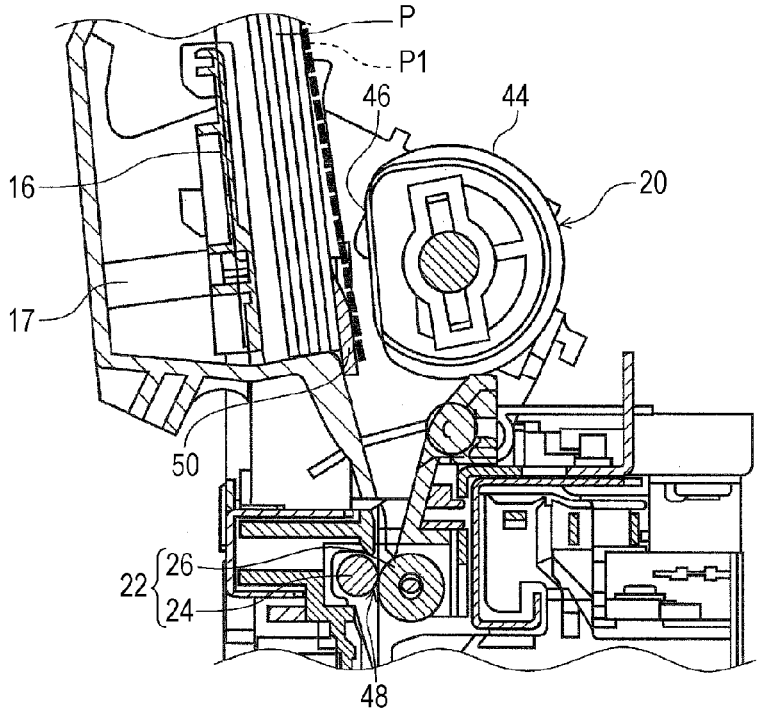
FIGS. 5A and 5B are diagrams for explaining the separation mechanism of the embodiment of the invention; specifically.
Figure 5B:
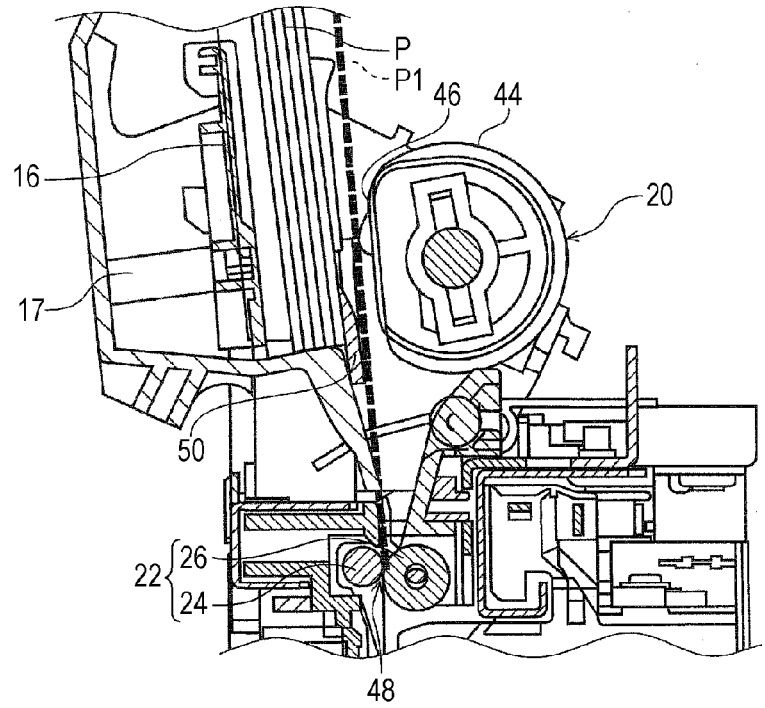

In the present embodiment, an ink-jet printer is taken as an example of the recording apparatus. FIG. 1 is a perspective view of the body of a printer according to an embodiment of the invention. FIG. 2 is a side sectional view of the medium transportation path of a printer according to an embodiment of the invention. FIG. 3 is an enlarged view of an essential part of a printer according to an embodiment of the invention. FIGS. 4A and 4B are diagrams for explaining a separation mechanism according to an embodiment of the invention; specifically, FIG. 4A shows a state before separation, and FIG. 4B shows a state in which the top sheet of paper has been fed to a position upstream of a restricting portion. FIGS. 5A and 5B are diagrams for explaining the separation mechanism of the embodiment of the invention; specifically, FIG. 5A shows a state in which the leading edge of the separated sheet has gotten over the upper end of the restricting portion, and FIG. 5B shows a state in which the leading edge of the separated sheet has arrived at the nip portion of a pair of transportation rollers.

In the X-Y-Z coordinate system of each of the drawings, the X direction represents the direction of recording head scan. The Y direction represents the direction of the depth of the recording apparatus. The Z direction represents the direction of gravity. In the explanation of each of the drawings, the +Y direction is defined as the direction toward the front of the apparatus, and the −Y direction is defined as the direction toward the rear of the apparatus. The +X direction is defined as the direction toward the right side of the apparatus as viewed from the front, and the −X direction is defined as the direction toward the left side of the apparatus as viewed from the front. The +Z direction is defined as the direction toward the top of the apparatus, and the −Z direction is defined as the direction toward the bottom of the apparatus.

First, with reference to FIGS. 1 and 2, an ink-jet printer 10 according to an exemplary embodiment of the invention (hereinafter referred to as "printer 10") will now be explained briefly along the medium transportation path. The printer 10 illustrated in FIG. 1 has two selectable installation orientations: horizontal installation and vertical installation. In the former installation, paper P is transported in a substantially horizontal direction when it faces a recording head 28, which is a recording unit. In the latter installation, the paper P is transported in a substantially vertical direction when it faces the recording head 28. In the description below, vertical installation such as mounting on a wall is taken as an example.

In the printer 10, the paper P is transported in the −Z direction in FIG. 1, that is, substantially vertically downward. In the following description, the direction of medium transportation in the printer 10 may be referred to as "downstream", and the opposite direction may be referred to as "upstream".

The printer 10 illustrated in FIG. 1 has a printer body 12. The installation surface 13 of the printer body 12 has a structure for mounting on, for example, a wall of a room. A medium tray 14, on which plural sheets of paper P can be set, is provided in the upper portion (+Z-directional portion) of the printer body 12 (FIG. 2). Specifically, the paper P is set on, and supported by, a hopper 16 (FIG. 2), which is a component of the medium tray 14. If the printer 10 is installed vertically, the paper P is supported substantially vertically. A paper support 18 is provided upstream of the hopper 16 in the paper transportation direction (at the +Z-directional side). The paper support 18 is a support member that supports the rear portion of the paper P, that is, portion not supported by the hopper 16.

The hopper 16 illustrated in FIG. 2 is pivotable so that its surface 16*a*, on which the paper P is set, can be moved toward and away from a paper feed roller 20. The hopper 16 is urged toward the paper feed roller 20 by an urging means 17. A restricting portion 50 is provided at the leading-edge side (downstream edge) of the set paper P. The restricting portion 50 is a separation mechanism for separating, into top one sheet, the paper P picked up from the medium tray 14 by the paper feed roller 20. The restricting portion 50 holds the leading edge of the sheets of the paper P to restrict movement toward the downstream side.

Among the plural sheets of the paper P set on the hopper 16, the top sheet P is in contact with the paper feed roller 20. The paper P is picked up due to the rotation of the paper feed roller 20, which is driven by a motor that is not illustrated in the drawing. For separation into one sheet, the top sheet P gets over the restricting portion 50. The separated sheet P moves downstream in the transportation direction. The picking up of the paper P by the paper feed roller 20 and the separation of the paper P by the restricting portion 50 will be described later.

The paper P sent from the upstream side in the transportation direction is transported by a pair of transportation rollers 22 to a recording position, at which it faces an ink-jet recording head 28 (hereinafter referred to as "recording head 28") functioning as a recording unit. The pair of transportation rollers 22 is made up of a driving transportation roller 24, which rotates when driven by a motor that is not illustrated in the drawing, and a driven transportation roller 26, which rotates as a slave while nipping the paper P between itself and the driving transportation roller 24.

The recording head 28 is provided on a carriage 30. Ink cartridges 32 for supplying ink to the recording head 28 are mounted on the carriage 30. Receiving power from a motor that is not illustrated in the drawing, the carriage 30 reciprocates in the direction of the width of the paper P (in the X direction).

A platen 34, which defines a gap between the ink ejection surface of the recording head 28 and the paper P, is provided opposite the recording head 28 (FIG. 2) (at the −Y side with respect to the recording head 28). Ink is ejected from the recording head 28 onto a medium such as the paper P, and, as a result, recording is performed between the recording head 28 and the platen 34.

An ejector 36 for ejecting the paper P after recording is provided downstream of the recording head 28 in the transportation direction. In the present embodiment, the ejector 36 includes a driving ejection roller 38 and a driven ejection roller 40, which rotates as a slave while nipping the paper P between itself and the driving ejection roller 38. An ejected sheet stacker 42, which receives the paper P from the ejector 36, is provided downstream of (at the −Z-directional side of) the ejector 36. Ejected sheets are stacked thereon.

The components described above are provided vertically along the medium transportation path in a case of vertical installation of the printer 10. In a case of vertical installation of the printer 10, the paper P is transported downward in a substantially vertical direction, and is thereafter ejected. In a case of horizontal installation, in which the installation surface 13 of the printer 10 is on a horizontal plane such as the top of a desk, the paper P goes through the same transportation path as above to undergo recording, and is thereafter ejected by the ejector 36. In this case, the paper P is transported in a substantially horizontal direction.

Next, with reference to FIGS. 3, 4A and 4B, and 5A and 5B, the picking up of the paper P set on the medium tray 14 by the paper feed roller 20 and the separation of the paper P by the restricting portion 50 will now be explained in detail. In the present embodiment, the paper feed roller 20 has an arc portion 44, which can be brought into contact with the paper P to feed the paper P, and a flat portion 46, which is never in contact with the paper P. The paper feed roller 20 has a shape that looks like an alphabet D in side view. The paper feed roller 20 rotates to bring its arc portion 44 into contact with the paper P. By this means, the paper feed roller 20 can pick up and feed the paper P. At a rotary position where the flat portion 46 faces the paper P as illustrated in FIG. 3, the paper feed roller 20 is not in contact with the paper P. Therefore, the feeding of the paper P by the paper feed roller 20 is released.

The restricting portion 50 functions as a separation mechanism for separating, into top one sheet, the paper P picked up from the medium tray 14 by the paper feed roller 20. The restricting portion 50 holds the leading edge of the sheets of the paper P set on the medium tray 14 to restrict the movement of the paper P toward the downstream side (refer to FIG. 3).

The paper feed roller 20 feeds the paper P toward the upstream side, that is, upward (in the +Z direction), and the top sheet P1 gets over the restricting portion 50. By this means, the restricting portion 50 performs sheet separation.

A more detailed explanation is given below while referring to the accompanying drawings. As illustrated in FIG. 4A, the hopper 16, on which plural sheets of paper P are set, is raised ("hopper UP") by the urging member 17. Among the sheets of the paper P, the top sheet P1 is positioned to be in contact with the arc portion 44 of the paper feed roller 20. The paper feed roller 20 rotates in the direction of an arrow A to feed the top sheet P1 toward the upstream side (upward in the drawing). Due to feeding by the paper feed roller 20, the top sheet P1 moves toward the upstream side until it is no longer under restriction by the restricting portion 50, or in other words, moves by a distance greater than an overlapping length L, which is the length of a portion where the set paper P and the restricting portion 50 overlap each other [refer to FIG. 4B].

The paper feed roller 20 further rotates in the direction of the arrow A to a position where its flat portion 46 faces the paper P as illustrated in FIG. 5A. At this rotary position, the top sheet P1 is not in contact with the paper feed roller 20. That is, pickup operation by the paper feed roller 20 is released. The top sheet P1 gets over the restricting portion 50 to be separated from the other sheets of the paper P.

The upstream-side end of the restricting portion 50 has a sloped surface 52 functioning as a guide that helps the leading edge of the top sheet P1 of the paper picked up from the medium tray 14 to get over the restricting portion 50. With the sloped surface 52, it is possible to reduce a risk that the leading edge of the top sheet P1 will get caught on the restricting portion 50. By this means, the sheet P1 can get over the restricting portion 50 smoothly. When the sloped surface 52 is formed, the shape of the restricting portion 50 is not limited to a trapezoidal shape in side view in FIG. 3. For example, the restricting portion 50 may have a triangular shape in side view by sloping its entire guiding surface from the upstream-side end to the downstream-side end.

After getting over the restricting portion 50, the top sheet P1 is in a free state of being not in contact with the paper feed roller 20. The top sheet P1 moves downward (in the −Z direction) due to its own weight to the nip position 48 of the pair of transportation rollers 22 [refer to FIG. 5B]. The sheet P1 is nipped by the pair of transportation rollers 22 (the driving transportation roller 24 and the driven transportation roller 26) to be transported downstream to the recording position of the recording head 28. Recording is performed at the recording position.

With the restricting portion 50 of the present embodiment described above, it is possible to shorten the feed distance of the paper feed roller 20 because the leading edge of the top sheet P1 moves to arrive at the nip position 48 of the pair of transportation rollers 22 due to sheet's own weight without being fed by the paper feed roller 20 after separation by the restricting portion 50. More specifically, regarding the feed distance of the paper feed roller 20, it suffices if the top sheet P1 can get over the restricting portion 50; that is, it suffices if the top sheet P1 moves by a distance greater than the overlapping length L, which is the length of a portion where the paper P set on the medium tray 14 and the restricting portion 50 overlap each other [refer to FIG. 4B]. The shortened feed distance of the paper feed roller 20 makes it possible to prevent, or reduce a risk of, the occurrence of the skew of the paper P arising from feeding by the paper feed roller 20.

Preferably, the leading edge of the sheet P1 should move to the nip portion 48 of the pair of transportation rollers 22 in a state in which the driving of the pair of transportation rollers 22 is stopped. Since the sheet P1 moving with a momentum due to its own weight collides with the pair of transportation rollers 22 that is in a stopped state, the leading edge of the sheet P1 comes into alignment with the nip portion 48. By this means, it is possible to correct the skew of the paper P1 easily. The skew correction makes it possible for the pair of transportation rollers 22 to transport the sheet P1 with increased stability in the attitude of the sheet P1. A sensor for detecting a paper edge may be provided near and upstream of the pair of transportation rollers 22. With such a sensor, it is possible to detect the arrival of the sheet P1 at the nip portion 48 and drive the pair of transportation rollers 22, and to start recording by the recording head 28.

As described above, the sufficient distance of feeding by the paper feed roller 20 is a distance by which the top sheet P1 can get over the restricting portion 50 [the distance greater than the length L of the portion where the paper P and the restricting portion 50 overlap each other in FIG. 4B]. The short length L makes it possible to reduce the size of the paper feed roller 20, thereby reducing the size of the printer 10.

Since the restricting portion 50 holds the leading edge of the sheets of the paper P set on the medium tray 14, even though the medium tray 14 is in substantially vertical orientation in the present embodiment, it is possible to prevent, or reduce a risk of, an avalanche phenomenon, that is, the downward surge of the leading edge of the set sheets of the paper P. The phenomenon mentioned above is not limited to a case where the medium tray is in substantially vertical orientation. It could occur also in a case of steep-slope tray orientation. In the present embodiment, it is assumed that the printer 10 is installed vertically. However, steep-slope tray orientation is employed in some horizontal-installation printers for the purpose of saving space in the depth direction. The invention is effective in such a case, too.

Second Embodiment

Figure 6:
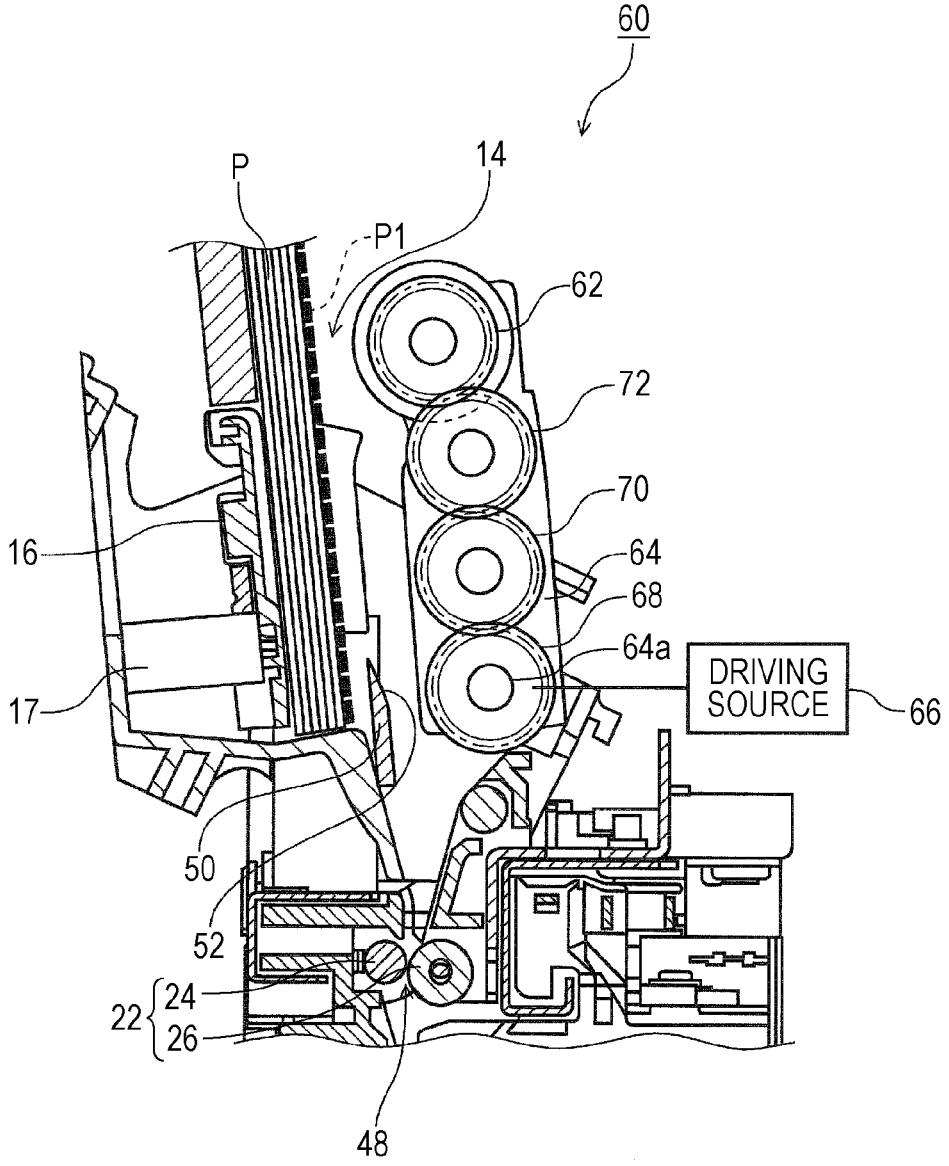
FIG. 6 is an enlarged view of an essential part of a printer according to another embodiment of the invention.
Figure 7A:
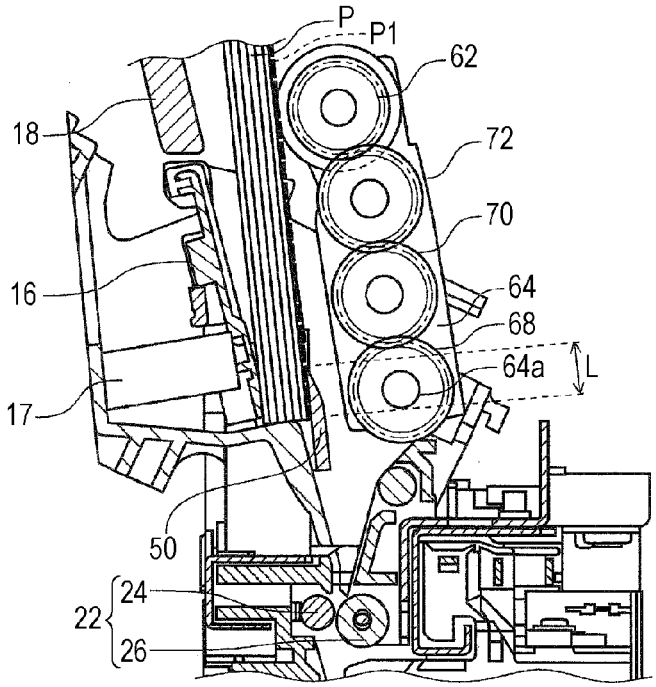
FIGS. 7A and 7B are diagrams for explaining a separation mechanism according to another embodiment of the invention; specifically.
Figure 7B:
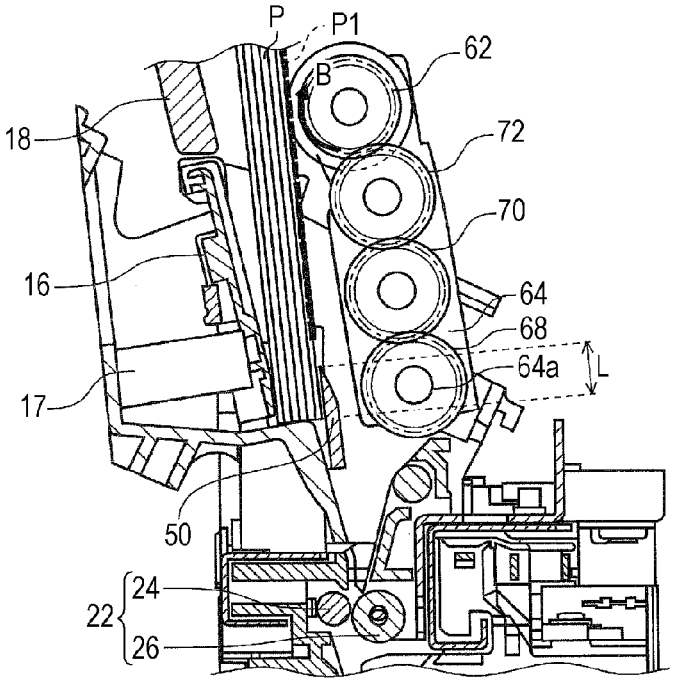
Figure 8A:
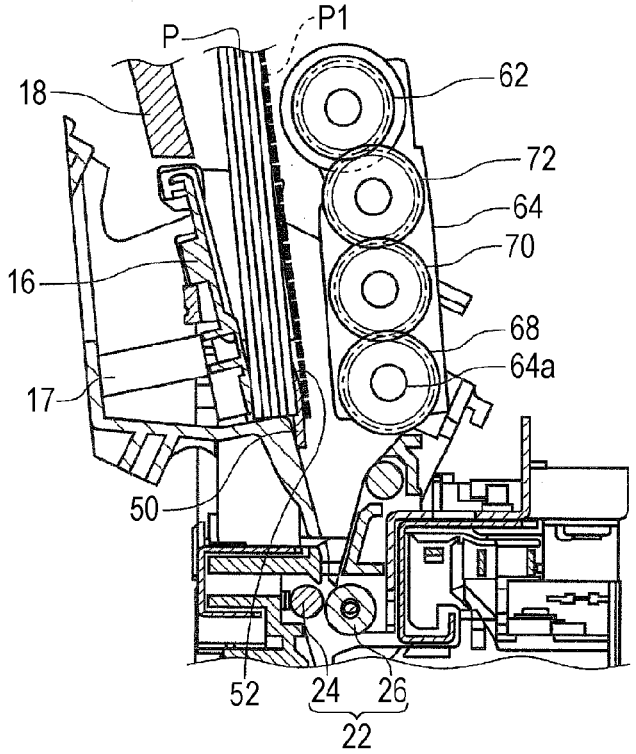
FIGS. 8A and 8B are diagrams for explaining the separation mechanism of the embodiment of the invention; specifically.
Figure 8B:
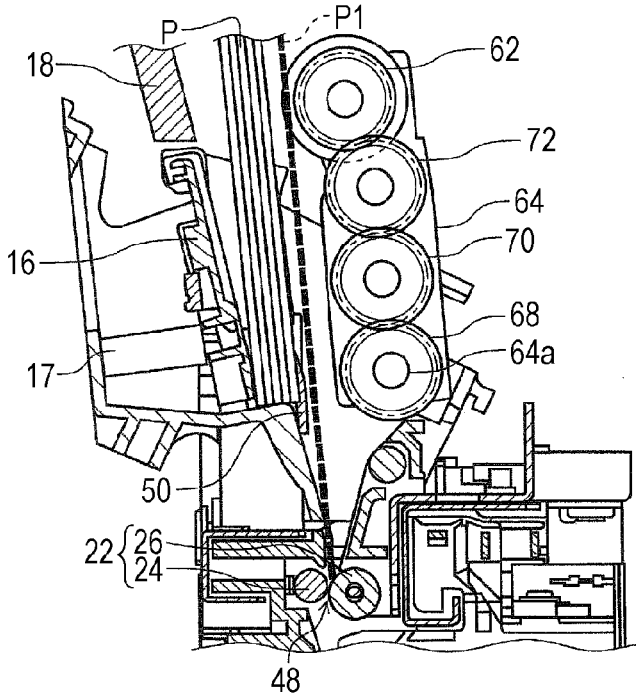

Next, with reference to FIGS. 6, 7A and 7B, and 8A and 8B, a recording apparatus according to another embodiment of the invention will now be explained. FIG. 6 is an enlarged view of an essential part of a printer according to another embodiment of the invention. FIGS. 7A and 7B are diagrams for explaining a separation mechanism according to another embodiment of the invention; specifically, FIG. 7A shows a state before separation, and FIG. 7B shows a state in which the top sheet of paper has been fed to a position upstream of a restricting portion. FIGS. 8A and 8B are diagrams for explaining the separation mechanism of the embodiment of the invention; specifically, FIG. 8A shows a state in which the leading edge of the separated sheet has gotten over the upper end of the restricting portion, and FIG. 8B shows a state in which the leading edge of the separated sheet has arrived at the nip portion of a pair of transportation rollers. In the present embodiment, the same reference numerals are assigned to the same components as those of the first embodiment. The same components are not explained here.

A paper feed roller 62 of a printer 60 according to the present embodiment is provided on a pivotable arm 64, which can move toward and away from paper P. The pivotable arm 64 pivots on a pivot shaft 64*a*, which is provided at the downstream side with respect to the paper feed roller 62. The paper feed roller 62 is configured to rotate by receiving a driving force from a driving source 66. A first gear 68, which rotates by receiving the driving force from the driving source 66, is provided coaxially with the pivot shaft 64*a*. The driving force of the driving source 66 is transmitted to the paper feed roller 62 via a second gear 70 and a third gear 72.

In the present embodiment, as in the foregoing embodiment, the paper feed roller 62 feeds the paper P set on the medium tray 14 toward the upstream side, that is, upward (in the +Z direction), and the top sheet P1 gets over the restricting portion 50. Sheet separation is performed in this way.

With reference to the accompanying drawings, a more detailed explanation of the paper feed roller 62 is given below. As illustrated in FIG. 7A, the hopper 16, on which plural sheets of paper P are set, is raised by the urging member 17. In addition to this hopper UP operation, the pivotable arm 64 is driven to pivot in a direction in which the paper feed roller 62 moves toward the paper P, thereby bringing the paper feed roller 62 into contact with the top sheet P1. Next, the driving source 66 causes the paper feed roller 62 to rotate in the direction of an arrow B to feed the top sheet P1 toward the upstream side (upward in the drawing). Due to feeding by the paper feed roller 62, the top sheet P1 moves toward the upstream side by a distance greater than an overlapping length L, which is the length of a portion where the set paper P and the restricting portion 50 overlap each other [refer to FIG. 7B].

After the feeding of the paper P1 upward until its leading edge is positioned upstream of the restricting portion 50, the driving of the driving source 66 is stopped. In addition, as illustrated in FIG. 8A, the pivotable arm 64 is driven to pivot in a direction in which the paper feed roller 62 moves away from the paper P, thereby releasing the contact of the paper feed roller 62 and the top sheet P1. The top sheet P1 gets over the restricting portion 50 to be separated from the other sheets of the paper P.

The top sheet P1, which is in a free state after getting over the restricting portion 50, moves downward (in the −Z direction) due to its own weight to the nip position 48 of the pair of transportation rollers 22 [refer to FIG. 8B].

As described above, the driving source 66 drives the paper feed roller 62 until the top sheet P1 gets over the restricting portion 50, and the driving of the driving source 66 is stopped after the top sheet P1 has gotten over the restricting portion 50. Since the paper P set on the medium tray 14 is picked up in this way, after separation of the top sheet P1, it is possible to cause the sheet P1 to move due to its own weight to the nip position 48 of the pair of transportation rollers 22. Therefore, it is possible to shorten the feed distance of the paper feed roller 20. Consequently, the same operational effect as that of the first embodiment can be obtained.

In the present embodiment, since the pivot shaft 64*a* of the pivotable arm 64 is provided at the downstream side with respect to the paper feed roller 62, when the paper feed roller 62 feeds the paper P toward the upstream side, it is possible to obtain the pressing force of the paper feed roller 62 against the paper P by wedge effects.

An urging member that applies an urging force in a direction in which the paper feed roller 62 approaches the paper P may be provided on the pivotable arm 64. The urging supplements the pressing force of the paper feed roller 62 against the paper P.

In the present embodiment, pickup operation is released by stopping the rotation of the paper feed roller 62 and by causing the paper feed roller 62 to retract away from the paper P. However, the scope of the invention is not limited thereto. The rotation of the paper feed roller 62 may be stopped without retraction, and the paper feed roller 62 may be configured to rotate by following paper movement while remaining in contact with the paper P, which moves toward the downstream side due to its own weight.

For example, if the paper P is a heavy medium such as thick paper, it can move toward the downstream side due to its own weight against the contact load of the paper feed roller 62. By this means, it is possible to release pickup operation by the paper feed roller 20 by merely stopping the driving of the driving source 66. In a case where the paper feed roller 62 is retracted away from the paper P, the retraction may be performed without stopping the rotation of the paper feed roller 62. It is possible to release pickup operation by the paper feed roller 62 even if the paper feed roller 62 remains rotating.

Third Embodiment

Figure 9A:
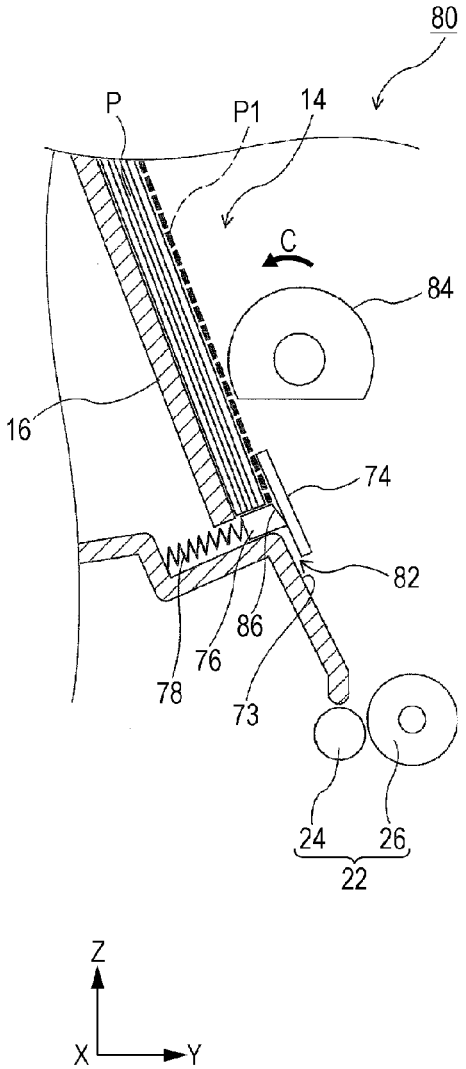
FIGS. 9A and 9B are diagrams for explaining a separation mechanism according to still another embodiment of the invention; specifically.
Figure 9B:
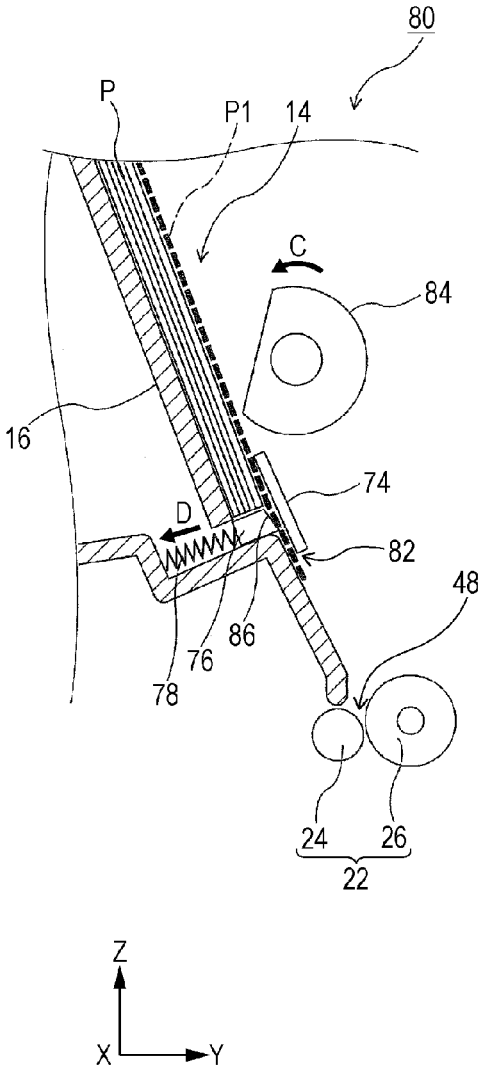

With reference to FIGS. 9A and 9B, a separation mechanism according to still another embodiment will now be explained. FIGS. 9A and 9B are diagrams for explaining a separation mechanism according to still another embodiment of the invention; specifically, FIG. 9A shows a state before separation, and FIG. 9B shows a state in which the top sheet of paper is separated. In the present embodiment, the same reference numerals are assigned to the same components as those of the first embodiment. The same components are not explained here.

In a printer 80 according to the present embodiment, as illustrated in FIG. 9A, a stopper 74 is provided at the downstream end of the medium tray 14. The stopper 74 holds the leading edge of the sheets of paper set on the medium tray 14 so that they will not move toward the downstream side. The paper P passes through a space (numeral 82) between the stopper 74 and a feeding surface 73. This space is hereinafter referred to as feeding clearance 82. The printer 80 has a clearance restricting portion 76, which is urged to close the feeding clearance 82. The numeral 78 denotes an urging member.

A paper feed roller 84 rotates in the direction of an arrow C to feed paper P toward the downstream side. As illustrated in FIG. 9B, the top sheet P1 pushes the clearance restricting portion 76 back in the direction of an arrow D against the urging force of the urging member 78 to pass through the feeding clearance 82 between the stopper 74 and the clearance restricting portion 76. A separation mechanism according to the present embodiment performs sheet separation in this way. Preferably, the clearance restricting portion 76 should have a guiding surface 86, which makes it easier for the top sheet P1 to go into the gap between the clearance restricting portion 76 and the stopper 74.

When the leading edge of the paper P1 passes through the feeding clearance 82, the contact of the paper feed roller 84 and the top sheet P1 is released, and the paper P1 moves due to its own weight to the nip position 48 of the pair of transportation rollers 22.

With the above structure, after separation of the top sheet P1, the sheet P1 moves due to its own weight to the nip position 48 of the pair of transportation rollers 22; therefore, it is possible to shorten the feed distance of the paper feed roller 20. Consequently, the same operational effect as that of the first embodiment can be obtained.

In the present embodiment, the paper feed roller 84, which has a shape that looks like an alphabet D in side view as in the first embodiment, is used. However, needless to say, a paper feed roller that rotates when driven by a driving source as in the second embodiment may be used.

Fourth Embodiment

Figure 10:
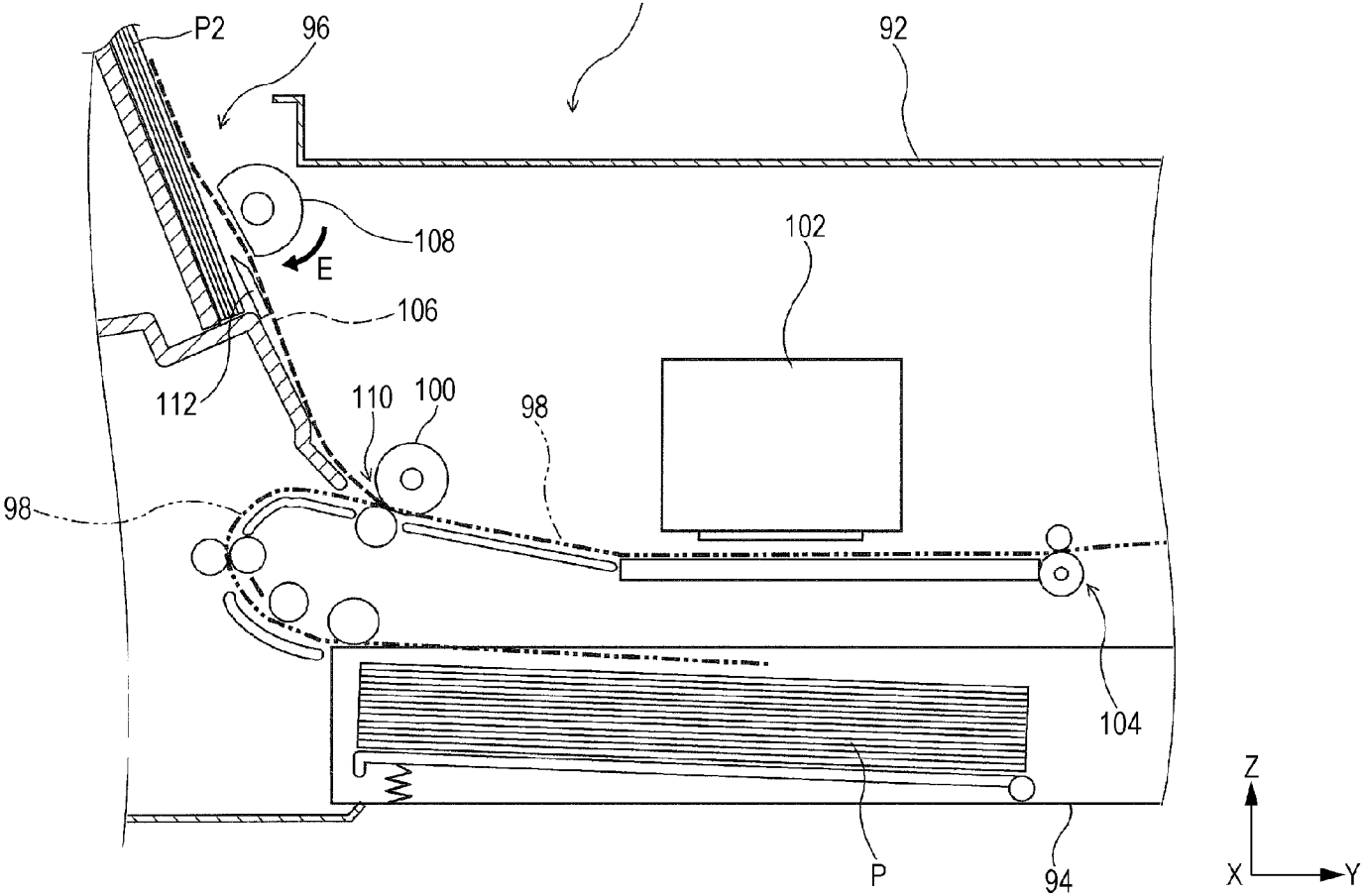
FIG. 10 is a diagram that illustrates an example of a case where paper set on the paper feed tray of a printer is separated.

In the first, second, and third embodiments, paper P is picked up from the medium tray of a printer on which plural sheets of paper have been set. As illustrated in FIG. 10, however, the invention can be applied to a case where paper P is picked up from a paper feed tray on which plural sheets of paper P can be set. An example of a case where paper set on the paper feed tray of a printer is separated is illustrated in FIG. 10.

A printer 90 has a tray 94 for paper P. The paper tray 94 is built in a print body 92 at a low position. A feeder tray 96, which enables paper to be supplied from the outside, is provided at an upper portion of the body 92 of the printer 90.

The path indicated by a dot-dot-dash line 98 is the transportation path of paper P from the paper tray 94. The paper P is transported in the −Y direction from the paper tray 94. After passing through the curved portion of the path, the paper P is transported by a pair of transportation rollers 100 toward a recording unit 102, which is located at the +Y-directional side. After recording at the recording unit 102, the paper P is ejected by a pair of eject rollers 104.

The path indicated by a broken line 106 is the transportation path of paper P2 from the feeder tray 96. The transportation path 106 of the paper P2 and the transportation path 98 of the paper P from the paper tray 94 meet at the position of the pair of transportation rollers 100.

Plural sheets of paper P2 can be set on the feeder tray 96. A paper feed roller 108 for picking up the sheets P2 sequentially, one sheet at a time, is provided. A restricting portion 112, which restricts the movement of the leading edge of the paper P2 toward the downstream side and separates the paper P2 fed by the paper feed roller 108 into top one sheet, is provided at the downstream end of the feeder tray 96.

The paper feed roller 108 rotates in the direction of an arrow E to feed the paper P2 set on the feeder tray 96 toward the upstream side. The contact of the top sheet and the paper feed roller 108 is released, and the sheet having gotten over the restricting portion 112 moves due to its own weight to the nip position 110 of the pair of transportation rollers 100. With the above structure of the present embodiment, the same operational effect as that of the first embodiment can be obtained.

In the foregoing embodiments, the pair of transportation rollers 22, 100 may be SMAP rollers, or rollers that are provided upstream of SMAP rollers and correct skew (resist rollers). The scope of the invention is not limited to the foregoing embodiments. The invention can be modified in various ways within the scope of the recitation of appended claims. Needless to say, those are within the scope of the invention.

The entire disclosure of Japanese Patent Application No.: 2015-018140, filed Feb. 2, 2015 is expressly incorporated by reference herein.

What is claimed is:

1. A recording apparatus, comprising:

a medium tray on which a medium is set vertically, or with a tilt;

a feed roller that feeds the medium set on the medium tray by rotating while being in contact with the medium;

a recording unit that performs recording on the medium, wherein the recording unit is downstream of the feed roller;

an urging mechanism for urging the medium and/or the feed roller in a direction of coming closer; and a restricting portion that faces a recording surface at a lower edge portion of the medium set on the medium tray and restricts movement of the lower edge of the medium, wherein the feed roller feeds the medium in an upstream direction until the lower edge of the medium can get over an upper end of the restricting portion.

2. The recording apparatus according to claim 1, wherein the feed roller rotates by receiving a driving force from a driving source; and wherein the driving source performs driving until the medium gets over the restricting portion, and the driving of the driving source is stopped after the medium has gotten over the upper end of the restricting portion.

3. The recording apparatus according to claim 1, wherein the feed roller has an arc portion that can be brought into contact with the medium to feed the medium, and a flat portion that is never in contact with the medium, and wherein the contact with the medium having gotten over the upper end of the restricting portion is released when the flat portion is positioned to face the medium.

4. The recording apparatus according to claim 2, wherein the feed roller is provided on a pivotable arm that pivots on a pivot shaft; and wherein the pivot shaft is provided at a downstream side with respect to the feed roller.

5. The recording apparatus according to claim 2, wherein the feed roller is provided on a pivotable arm that pivots on a pivot shaft; and wherein the pivotable arm includes, as the urging mechanism, an urging member that urges the feed roller in a direction in which the feed roller comes closer to the medium.

6. The recording apparatus according to claim 1, wherein the feed roller has a sloped surface functioning as a guide that helps the lower edge of the medium picked up from the medium tray to get over the restricting portion.

7. The recording apparatus according to claim 1, further comprising:

a pair of transportation rollers that is provided between the restricting portion and the recording unit and transports the medium toward the recording unit while nipping the medium;

wherein feeding of the medium by the feed roller is released after the medium has gotten over the upper end of the restricting portion, and the medium moves due to its own weight to a nip position of the pair of transportation rollers.

8. The recording apparatus according to claim 7, wherein the lower edge of the medium moves to the nip position of the pair of transportation rollers in a state in which the driving of the pair of transportation rollers is stopped.

* * * * *